US006874628B2

(12) United States Patent
Hammill

(10) Patent No.: US 6,874,628 B2
(45) Date of Patent: Apr. 5, 2005

(54) RETAINER FOR HOLDING A GUN IN A CASE

(75) Inventor: Robert N. Hammill, Kent, OH (US)

(73) Assignee: Flambeau Products Corporation, Middlefield, OH (US)

( * ) Notice: Subject to any disclaimer, the term of this patent is extended or adjusted under 35 U.S.C. 154(b) by 126 days.

(21) Appl. No.: 10/353,899

(22) Filed: Jan. 29, 2003

(65) Prior Publication Data

US 2004/0144664 A1 Jul. 29, 2004

(51) Int. Cl.[7] ..... F41C 33/06
(52) U.S. Cl. ..... 206/317; 206/481; 206/523
(58) Field of Search ..... 206/14, 314, 315.11, 206/317, 481, 523, 575, 579; 224/246, 250, 913; 248/499, 505

(56) References Cited

U.S. PATENT DOCUMENTS 2,226,409 A * 12/1940 Patterson et al. ..... 206/478
2,321,807 A * 6/1943 Glickman ..... 132/312
2,706,036 A * 4/1955 Neal ..... 206/317
D203,101 S * 12/1965 Holder ..... D3/218
4,190,152 A * 2/1980 Reiter ..... 206/314
4,234,116 A * 11/1980 Myers ..... 224/250
4,334,612 A * 6/1982 Beato ..... 206/314
4,461,332 A * 7/1984 Parkhurst ..... 150/112
4,836,374 A * 6/1989 Hutchins et al. ..... 206/373
4,901,464 A * 2/1990 Banoun ..... 42/95
D340,131 S * 10/1993 Cassidy, IV ..... D3/254
5,678,686 A * 10/1997 Hagemann et al. .... 206/315.11
5,845,780 A * 12/1998 Allen ..... 206/579
6,009,996 A * 1/2000 Purdy ..... 206/317
6,029,804 A * 2/2000 Flynn ..... 206/14
6,250,470 B1 * 6/2001 Mackenzie ..... 206/579
6,499,592 B2 * 12/2002 Wilfer ..... 206/314

* cited by examiner

*Primary Examiner*—John A. Ricci

(57) ABSTRACT

A retainer is provided for holding a gun in a rigid case. The case contains a low stiffness cushion material and the gun, including its rear stock and fore stock, located in engagement with one side of the cushion material. Support members each having a stiffness greater than the stiffness of the cushion material engage the other side of the cushion material opposite the fore stock and rear stock. A strap extends around the support member opposite the rear stock, through the cushion member and tightly around the rear stock. Another strap extends around the support member opposite the fore stock, through the cushion member and tightly around the fore stock. The support members and straps together hold the gun located in the case.

20 Claims, 3 Drawing Sheets

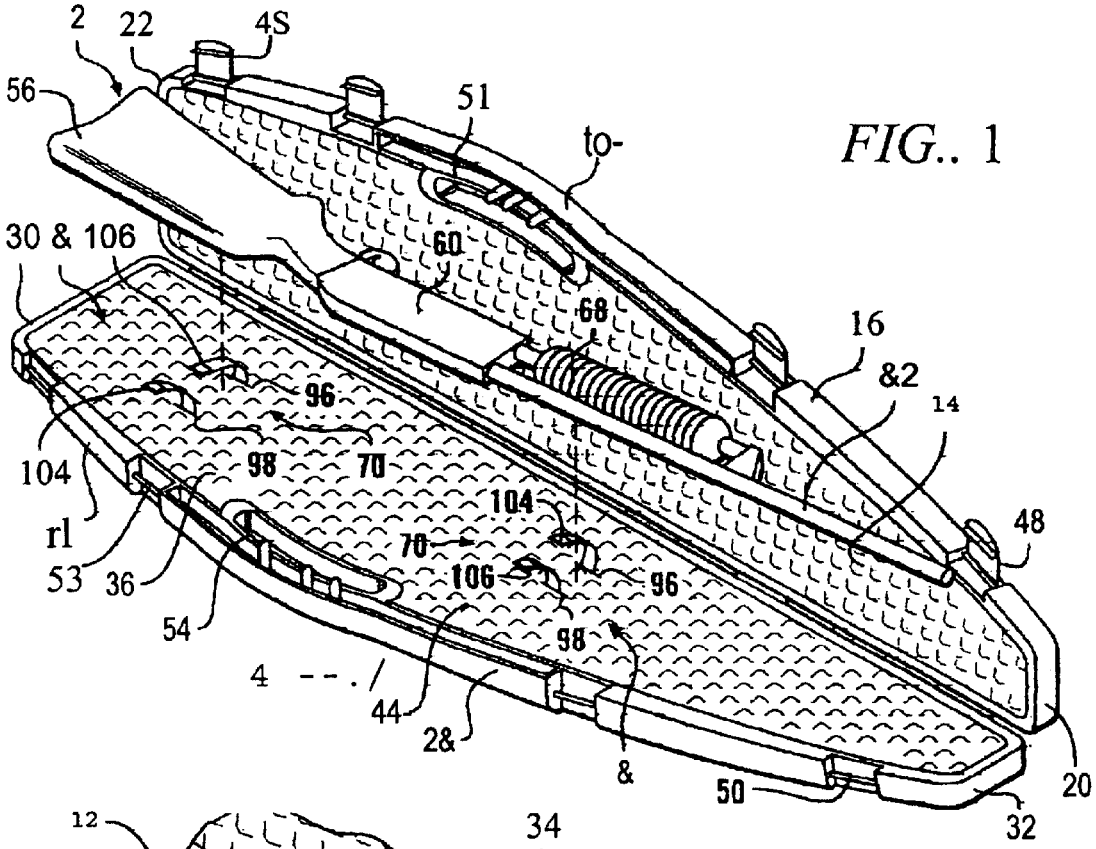
FIG.. 1
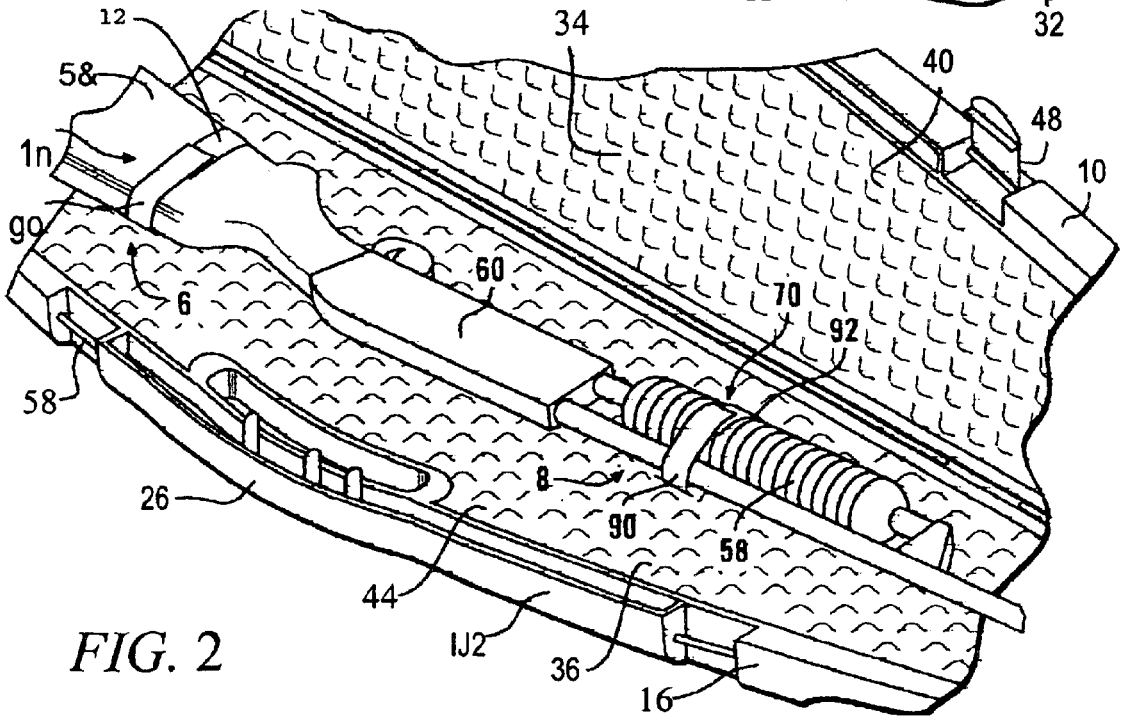
FIG. 2

FIG. 3
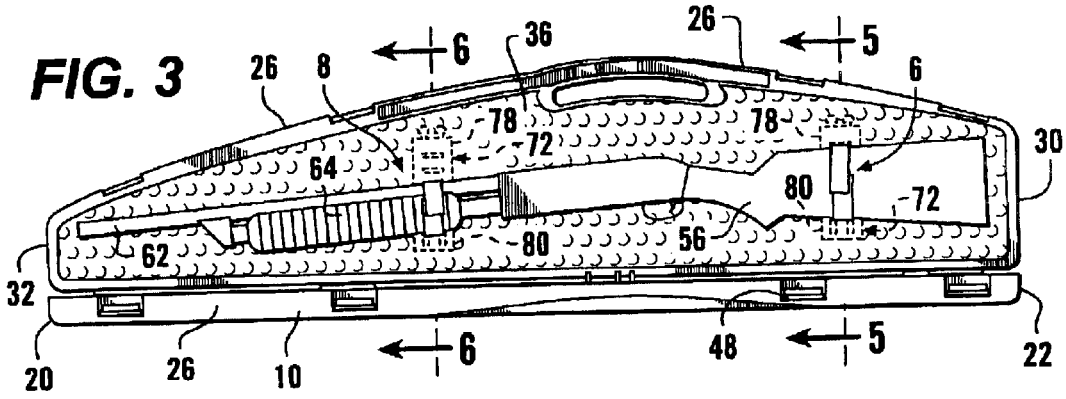
FIG. 4
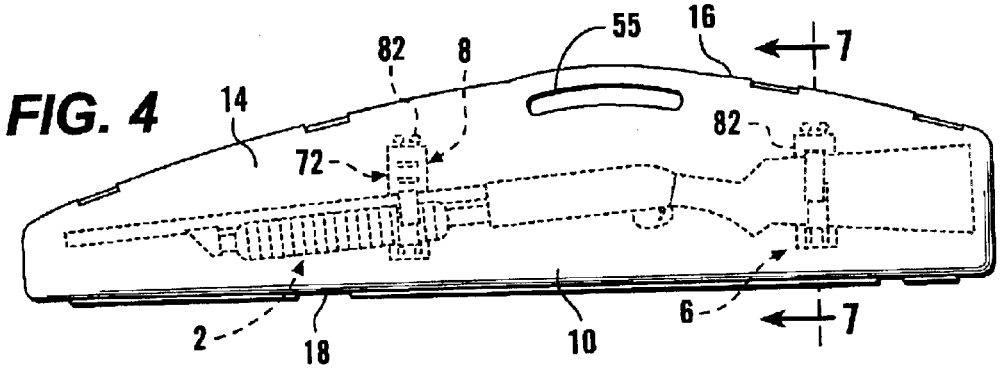
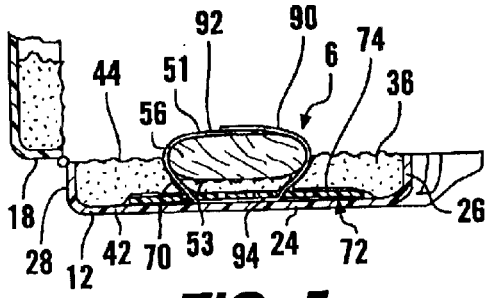
FIG. 5
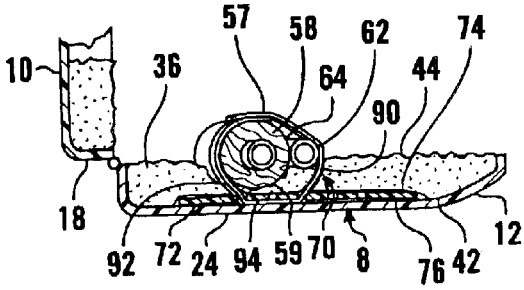
FIG. 6
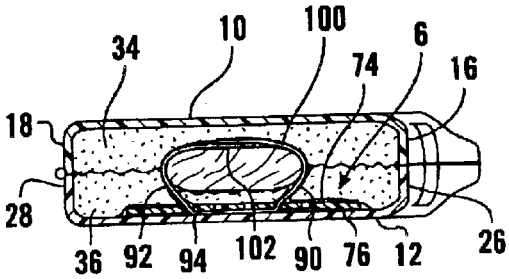
FIG. 7

RETAINER FOR HOLDING A GUN IN A CASE

BACKGROUND OF THE INVENTION

1. Field of the Invention

This invention relates generally to gun cases of a rigid construction. More particularly, the invention relates to a retainer for holding rifles, shotguns or other guns in a case.

2. Description of the Related Art

Cases for guns are commonly used for storing, carrying and otherwise transporting various types of guns. At the same time, the cases are designed and constructed to prevent damage to the guns and otherwise protect them. Gun cases are typically used for many years and they should therefore also be of a durable construction. To meet the foregoing requirements, gun cases of a rigid construction, typically of a plastic material such as HDPE, ABS, or any other plastic alloy, have been developed. Although cases of a rigid construction contribute significantly to protection of the gun and durability of the case, they also increase the cost of such a case. Increased cost is, of course, undesirable from a commercial, competitive aspect. Cushioning material is incorporated in the rigid case, so that, when the case is closed the case together with the cushioning material sandwiches the gun to protect it and hold it within the case. Cases of this type are commercially available for both a single gun and several guns sandwiched in the case between cushioning material.

Although the gun is held sandwiched between the cushion material within the rigid case, movement of the case during transporting tends to cause the gun to move between the cushion material toward the periphery of the latter and into engagement with a rigid case wall. Such movement of the gun may also be contributed to by bunching or compression of the cushioning material within the case. Consequently, there is a need to provide gun holding means within the case beyond that provided by the sandwiching effect of the case and cushion material.

In Hagemann et al. U.S. Pat. No. 5,687,686, a strap and cradle combination is disclosed for holding a gun in a rigid case. This is a relatively expensive arrangement and uses a padded U-shaped cradle and straps to hold the gun in place. A U.S. Pat. No. 6,009,996 to Purdy discloses a soft-sided gun case having a shaped insert and straps attached to the insert to hold the gun in place. This arrangement does not use cushioning material to maintain the gun located within the case and also requires the attachment of the straps to the holding insert.

In view of the prior art described above, there continues to be a need for a gun retainer in a rigid case utilizing cushioning material to protect the gun which is more effective in maintaining the gun in place in a rigid gun case and protecting the gun, and has a relatively low cost.

BRIEF SUMMARY OF THE INVENTION

In a principle aspect, the present invention comprises a retainer for holding a gun in a case having a rigid structure. A relatively soft or low stiffness cushion material is contained within the case and the gun is located in engagement with one of the sides of the cushion material. Support means having a stiffness greater than the stiffness of the cushion material engages the other side of the cushion material opposite the location of the gun. Strap means extends around the support means, through the cushion material and around the gun to hold the support means in engagement with the cushion material and thereby provide the stiffness of the support means to the cushion material to maintain the cushion material in place.

It thus may be appreciated that a general object of the invention is to provide retainer means for holding a gun cushioned and stationary within a rigid gun case. A further object of the invention is to provide, in a rigid gun case containing cushion material engaging the gun, gun retainer means including support means having greater stiffness than the stiffness of the cushion material and engaging the cushion material for preventing movement of the gun and cushion material within the case.

Another object of the invention is to provide a retainer means for holding a gun in a rigid case containing a low stiffness cushion material having a side engaging the gun, the retainer means including attachment means extending through the cushion means and around a support means engaging the other side of the cushion material and around the gun to provide stiffening support to the cushion and prevent movement of the cushion material and thereby movement of the gun in the case.

A further object of the invention is to provide a retainer means for holding a pair of guns in a rigid case containing a low stiffness cushion material engaging the guns, the retainer means including two support members engaging the cushion material and each having a stiffness greater than that of the cushion material and connectable together to provide stiffening support to the cushion material and prevent movement of the cushion material and both guns in the case.

BRIEF DESCRIPTION OF THE DRAWINGS

Further objects and advantages of the invention will appear when taken in conjunction with the accompanying drawings in which:

FIG. 1 is a perspective view of a gun case and gun out of the case, illustrating the gun retainer means according to the present invention;

FIG. 2 is an enlarged fragmentary perspective view similar to FIG. 1 with the gun located in the case;

FIG. 3 is a plan view of the gun case open and without a cover and the gun located in the case;

FIG. 4 is a plan view of the gun case with the cover closed and the gun located in the case;

FIG. 5 is a sectional view along lines 5—5 of FIG. 3;

FIG. 6 is a sectional view along lines 6—6 of FIG. 3;

FIG. 7 is a sectional view along lines 7—7 of FIG. 4;

DETAILED DESCRIPTION OF THE INVENTION

Figure 8A:
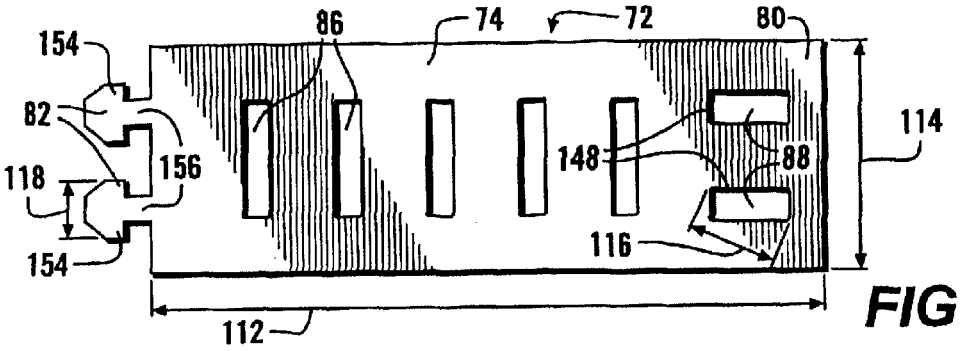
FIG. 8A is a plan view of a single retainer with protruding ends.

Referring generally to the figures, a gun 2, a gun case 4 for the gun, and retainer means 6 and 8 for holding the gun 2 in the case 4 are illustrated. The case 4 is of an elongated type having a length, a width less than the length, a cover 10 and a base 12 of a rigid plastic or other rigid non-plastic material. The cover 10 includes a top wall 14, elongated and spaced apart side walls 16, 18 extending in the direction of the case length, and end walls 20, 22. The base 12 includes a bottom wall 24, elongated and spaced apart side walls 26, 28, and end walls 30, 32. Cushion material 34, 36 are respectively positioned within the cover 10 and the base 12. The cushion material 34 has a side 40 and the cushion material 36 has opposite facing sides 42, 44 respectively facing toward the bottom wall 24 of the base and toward the gun 2 when the gun is positioned in the case 4 as shown in FIGS. 2–6. The cushion material 34 and 36 is of a soft plastic foam or other soft material having a relatively low stiffness for padding and protecting the gun 4 in the case 2.

Hinges 46 are affixed to the side wall 16 of the cover 10 and to the side wall 26 of the base 12 to permit pivotal movement of the cover and base between the open position as shown in FIGS. 1 and 2 and the closed position as shown in FIG. 7. Latch tabs 48 extend from the side wall 18 of the cover 10 and releasably connect to pin catches 50 incorporated in the side 28 of the base 12 to hold the cover and base together when they are closed. Handle openings 52, 54 respectively extend through the top wall 14 and the bottom wall 24 to form a handle 55 for carrying the case 4 when it is in the closed positioned shown in FIG. 4.

The gun 2 may be of an elongated type, such as a rifle or shotgun, and is positioned in the case 4 intermediate the side walls 26, 28 of the base 12 and the side walls 16, 18 of the cover 10. The gun 2 has a wooden or plastic stock which may be of a single piece, or of two pieces as shown in FIGS. 1–4. The stock of gun 2, then, comprises a rear stock 56 and a fore stock 58 separated by a receiver 60. A gun barrel 62 extends from the receiver 60 along an upper edge 64 of the fore stock 58. The rear stock 56 has an oval cross-section with opposite curved sides 51 and 53 and the fore stock 58 has a circular cross-section with opposite curved sides 57 and 59. The circular gun barrel 62 is immediately adjacent the fore stock 58, as respectively shown in FIGS. 5 and 6. As also shown in FIGS. 5 and 6, the rear stock 56 and fore stock 58 both engage the side 44 of the cushion material 36 when the gun is in the case.

The retainer means 6 and 8 are respectively shown in FIGS. 5 and 6 and in the various other figures illustrating the invention. The retainer means 6 is located adjacent to and in engagement with rear stock 56 and includes a strap 70 and, with particular reference to FIGS. 8A and 8B, a support member 72. The support member 72 has a stiffness greater than that of the cushion material 36 and includes opposite sides 74, 76 with the side 74 being in engagement with the side 42 of the cushion material 36. The support member 72 further has opposite ends 78, 80, a pair of identical fingers 82 extending from the end 78, a plurality of spaced apart transverse slots 86, and a pair of openings 88 adjacent the end 80. The strap 70 may be of flexible plastic or textile material and has spaced apart end portions 90, 92 and a middle portion 94 connected to each of the end portions 90, 92. The end portions 90, 92 respectively extend through two different ones of the spaced apart slots 86 in the support member 72 and through slits 96, 98 in the cushion material 36 to positions respectively in engagement with the spaced apart curved side 5 of the rear stock 56 and around the rear stock 56. The distal end sections 100, 102 of the respective end portions 90, 92 include VELCRO surfaces 104, 106 for connecting the end portions 90, 92 together in their position wrapped around the rear stock 56 as shown in FIG. 5. With respect to the use of VELCRO for attachment of the end portions 90, 92, there are various other types of strap connector means known to persons skilled in the art that may also be suitable for such attachment and are within the scope of the present invention. However, it is important that any connector means used should not cause damage to the rear stock 56.

The middle portion 94 of the strap 70 has opposite sides 93 and 95 each having the same area determined by the dimensions of length 108 and width 110. The middle portion is positioned adjacent the side 44 of the cushion material 34 with the strap middle portion side 93 and its area in engagement with the side 76 of the support member 72. The support member 72 has an area determined by the dimensions of its length 112 and width 114 larger than the area of the middle portion 94. The length 112 of the support member 72 may also be longer than the length 108 of the middle portion 94 of the strap 70.

It may be appreciated from the foregoing detailed description of the invention that the middle portion 94 of the strap 70, bearing against the support member 72, will apply force to the support member 72 toward the cushion material 36 and gun 2 when the strap ends 90, 92 are pulled, and thereby placed under tension, around the curved sides 51 and 53 of the rear stock 56 and fastened together. The area and length of the support member 72, which are larger than the corresponding area and length of the strap middle portion 94, are held tightly against the soft cushion material 36 such that the higher stiffness of the support member 72 is in effect provided to the cushion material 36. The resulting stiffness imparted to the cushion material prevents it from moving or bunching within the case 4 and consequently also prevents movement of and holds the gun 2 in location.

The retainer means 8 functions to hold the gun 2 in the case 4 at the fore stock 58 location in the same manner as the retainer means 6 holds the gun 2 at the rear stock 56. Consequently, a detailed description for the retainer means is not necessary. Also, the components of the retainer means 8 are substantially identical to those of the retainer means 6 and, therefore, the identifying numbers in the figures remain the same.

Figure 8B:
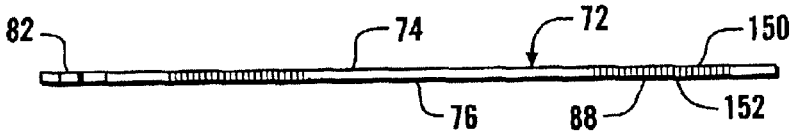
FIG. 8B is a side elevation view of the retainer of FIG. 8A.
Figure 8C:
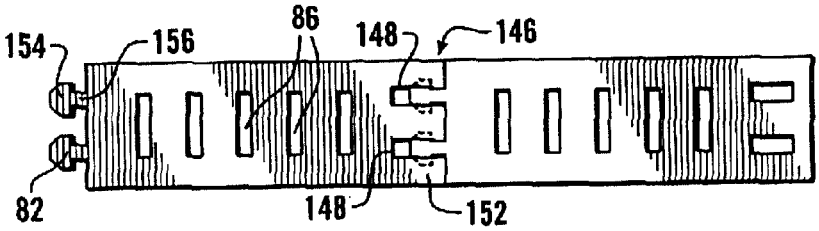
FIG. 8C is a plan view of two connected retainers.
Figure 9:
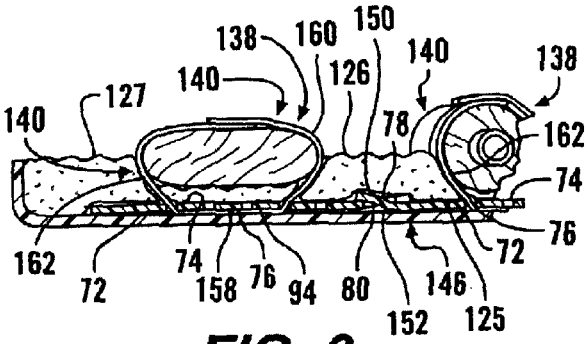
FIG. 9 is a side elevation sectional view along lines 9—9 of FIG. 11.
Figure 10:
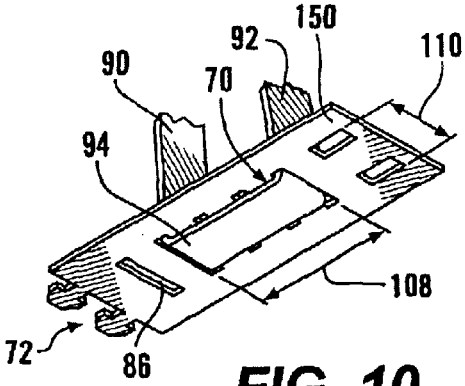
FIG. 10 is a perspective view of a support member and strap according to the present invention.
Figure 11:
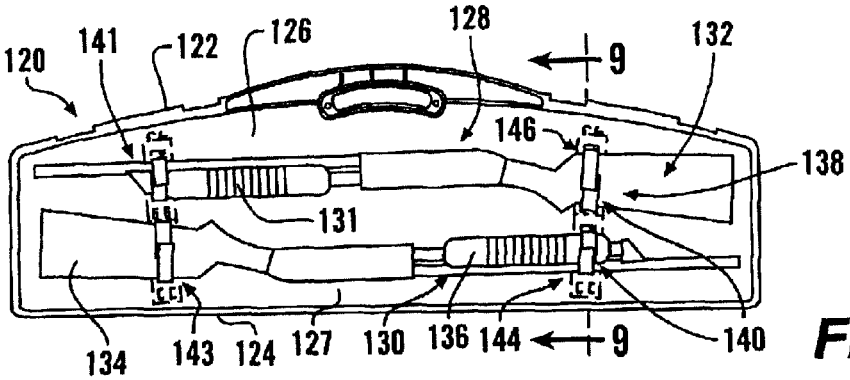
FIG. 11 is a plan view of a gun case and gun retainer means illustrating an alternate embodiment of the invention.

With reference to FIGS. 8C, 9 and 11, an alternate embodiment of the invention for retaining two guns in a case is shown. In FIGS. 8C, 9 and 11, only those elements will be identified by number which are necessary to describe the modifications of the alternate embodiment. It may also be noted that the support members shown in FIGS. 8A and 8B are also utilized in the embodiment of FIGS. 8C, 9 and 11 and therefore the identifying numbers of FIGS. 8A and 8B will also be in the alternative embodiment description. In FIG. 11, a rigid gun case 120 has elongated spaced apart rigid sides 122, 124 and cushion material 126 having sides 125 and 127 positioned within the case. A pair of guns 128, 130 are positioned generally parallel to each other in engagement with the cushion material 126 and spaced apart from the case sides 122, 124 and from each other. The gun 128 has a rear stock 132 and a fore stock 131, and the gun 130 has a rear stock 134 and a fore stock 136.

A retainer means 138 for the gun 128 includes a strap 140 and a support member 72 as shown in FIGS. 8A and 8B comprising part of a dual support 146. As shown in FIG. 8C, the dual support 146 includes two support members 72 each having an end 78 and an end 80. The end 80 has a pair of identical openings 88 each with a perimeter 148, an entrance area 150 adjacent the opening 88, and an exit area 152 adjacent the opening 88. Each of the perimeters 148 of each opening 88 has a maximum spacing between any two locations on the perimeter, which, in the case of a rectangular opening 88 as illustrated in FIG. 8C, is the diagonal 116 of the rectangle. A pair of identical fingers 82 extend from the end 78. The fingers 82 each include a distal head 154 having a width 118 wider than the maximum spacing or diagonal 116 of each opening perimeter 148 and spaced from the end 78, and a neck 156 narrower than the width 116, of the head and connecting the end 78 to the head 154. The dual support 146 is formed by inserting the heads 154 and necks 156 extending from the end 78 of a support member 72 through the openings 88 from an entrance area 150 at the end 80 of the support member 144. The heads 154 are deformable such that the width of the heads can be decreased to a space less than the maximum spacing of the opening perimeters 148 to permit their insertion through the openings. After such insertion of the heads 154 through the openings 188, the heads will bear against the exit areas 152 at the ends 80 of the support member 144. This arrangement thus forms each dual support 146 shown in FIG. 8C. Further, as shown in FIGS. 9 and 11, the dual support 146 is positioned in the case 120 transversely to the elongated sides 122, 124 and in engagement with the side 125 of the cushion material 126 and adjacent the position of the rear stock 130.

The strap 140 has a middle portion 158 and spaced apart end portions 160, 162 connected to the middle portion. The strap middle portion 158 engages the support member 72 at a position such that the latter is between the cushion material 126 and the strap middle portion 158. The support member 72 has a stiffness greater than that of the cushion material 126 and an area and length greater than those of the strap middle portion 158.

The strap end portions 160, 162 extend through different ones of the slots 86 of the support member 72 and through the cushion material 126 to respectively adjacent opposite curved sides of the rear stock 132. The end portions 160, 162 are pulled and wrapped relatively tightly around the rear stock 132 and connected together with VELCRO material 104 and 106. The wrapping and holding of the strap end portions around the rear stock applies force to the strap middle portion 158 and thus to the support member 72. Thus, due to the stiffness of the support member 72 and the larger area and longer length of the support member 72 relative to the area and length of the strap middle portion 158, the cushion material 126 is provided with support and stiffness which maintains it and the gun stationary and properly positioned within the case 120.

A retainer means 144 for the gun 130 utilizes a support member 74, which is part of the dual support 146, and includes a strap 142 which is wrapped around the fore stock 136 of the gun 130. The retainer means 144 is otherwise virtually identical to the retainer means 138 and will not be described in detail. Similarly, retainer means 141 and 143, as shown in FIG. 11, are virtually identical to the retainer means 138 and will not be described in detail.

It will be understood that the foregoing description of the present invention is for purposes of illustration only and that the invention is susceptible to a number of modifications or changes, none of which entail any departure from the spirit and scope of the present invention as defined in the hereto appended claims.

What is claimed is:

1. Retainer means for holding a first gun in a case having two spaced apart elongated rigid walls, comprising:

cushion material positioned between the two spaced rigid walls, the cushion material having opposite sides and a predetermined stiffness, the first gun having a position of engagement with one of the sides intermediate the two spaced rigid walls of the case;

support means having a stiffness greater than that of the cushion material, the support means being in engagement with the other of the sides of the cushion material adjacent the position of engagement of the first gun with the cushion material and extending in engagement with the cushion material toward the two spaced rigid walls; and attachment means extending through the cushion material and around the support means and the first gun for holding the gun and support means in engagement with the cushion material to thereby provide the stiffness of the support means to the cushion material and prevent undesired movement of the cushion material and gun within the case.

2. The retainer means according to claim 1 wherein the support means extends away from the attachment means and toward the rigid walls.

3. The retainer means according to claim 1 wherein the cushion material, support means and attachment means are not affixed to the case.

4. The retainer means according to claim 1 wherein:

the attachment means comprises strap means having a predetermined area in engagement with the support means and over which the strap means applies force to the support means to hold the support means in engagement with the cushion material; and the support means has a predetermined area larger than that of the strap means in engagement with the cushion material, the larger area of the support means receiving the force of the strap means to thereby enlarge the distribution of the force of the strap means on the cushion material and prevent tearing of the cushion material due to said force.

5. The retainer according to claim 4 wherein the area of the support means extends away from the strap means and toward the two spaced rigid walls.

6. The retainer means according to claim 1 for holding the first gun and a second gun in said case, wherein:

the first and second guns are spaced apart and generally parallel to each other and in engagement with the same one of the sides of the cushion material intermediate the two spaced rigid walls of the case;

the support means comprises first and second support means each having a stiffness greater than that of the cushion material, the first and second support means each being in engagement with the other of the sides of the cushion material respectively adjacent the position of engagement of the first gun and the second gun with the cushion material; and the attachment means comprises first and second attachment means respectively extending around the first support means and first gun and around the second support means and second gun for respectively holding the first gun and first support means and second gun and second support means in engagement with the cushion material to thereby provide the stiffness of the two support members to the cushion material and prevent undesired movement of the cushion material and guns within the case.

7. The retaining means according to claim 6 wherein:

the first support means extends toward the second support means and has a first end in engagement with the second support means, the first end having at least one opening including an entrance area and an exit area and a perimeter having a maximum spacing between any two locations on the perimeter; and the second support means extends toward the first support means and has a second end in engagement with the first support means, the second end having at least one extending finger including a narrow neck connected to the second end and a distal head spaced from the second end and having a width larger than said maximum spacing between any two locations on the perimeter of the opening, the neck extending through the opening from the entrance area to the exit area and the head engaging the exit area whereby the first and second support means are held connected together.

8. The retainer means according to claim 7 wherein the head of the finger is deformable to a width less than that of said maximum spacing between any two locations on the perimeter of the opening whereby the head of the finger is insertable through the opening.

9. A retainer for holding a gun in a rigid case comprising:

cushion material within the case, the cushion material having opposite sides and a predetermined stiffness, the gun being in engagement with one of the sides;

strap means having a middle portion adjacent the other of the sides of the cushion material and two spaced apart end portions connected to the middle portion and extending through the cushion material and into engagement with the gun for applying holding force to the gun and the cushion material to maintain the gun tightly against the cushion material; and support means having a stiffness greater than that of the cushion material and being positioned between and in engagement with the middle portion of the strap means and the other of the sides of the cushion material for receiving and transferring the force of the strap means to the cushion material and preventing tearing of the cushion material due to said force.

10. The retainer according to claim 9 wherein:

the support means has a length and a plurality of spaced apart openings along the length; and the two end portions of the strap means each extend through a different one of the spaced apart openings.

11. The retainer according to claim 10 wherein the middle portion of strap means has a length substantially parallel to the length of the support means.

12. The retainer according to claim 9 wherein:

the gun case has a length and a width less than the case length, the gun case including two spaced apart rigid walls extending in the direction of the case length;

the middle portion of the strap means has a length positioned transversely of the length of the gun case; and the support means has a length positioned transversely of the length of the gun case, the length of the support means being greater than that of the middle portion of the strap means.

13. The retainer according to claim 9 wherein:

the middle portion of the strap means has a predetermined area; and the support means has a predetermined area larger than that of the middle portion of the strap means, a portion of the predetermined area of the support means being in engagement with the middle portion of the strap means for enlarging the distribution of the force of the strap means on the cushion material.

14. The retainer according to claim 13 wherein the support means has spaced apart parallel sides, one of the parallel sides including the predetermined area of the support means.

15. The retainer according to claim 13 wherein:

the gun case has a length and a width less than the case length, the gun case including two spaced apart rigid walls extending in the direction of the case length;

the middle portion of the strap means has a length positioned transversely of the length of the gun case; and the support means has a length positioned transversely of the length of the gun case, the length of the support means being greater than that of the middle portion of the strap means.

16. The retainer according to claim 15 wherein:

the support means has a plurality of spaced apart openings along its length; and the two end portions of the strap means each extend through a different one of the spaced apart openings.

17. A retainer for holding a gun in a case having rigid walls, the gun having spaced apart rear and fore stocks, each of the rear and fore stocks having first and second opposing sides, comprising:

cushion material within the case, the cushion material having a low stiffness and opposite sides, the gun rear stock and fore stock being in engagement with the same one of the cushion material sides;

first and second support members each having first and second sides, the second side of the first support member and the second side of the second support member each being in engagement with the other of the sides of the cushion material respectively opposite the rear stock and the fore stock, the support members each having a stiffness greater than the stiffness of the cushion material;

a first strap having a middle portion in engagement with the first side of the first support member and first and second end portions each extending toward the rear stock through the first support member and the cushion material adjacent a different one of the first and second opposing sides of the rear stock and around the rear stock into holding engagement with each other whereby the gun rear stock is held against the cushion material; and a second strap having a middle portion in engagement with the first side of the second support member and first and second end portions each extending toward the fore stock through the second support member and cushion material adjacent a different one of the first and second opposing sides of the fore stock and around the fore stock into holding engagement with each other whereby the gun fore stock is held against the cushion material.

18. The retainer according to claim 17 wherein:

the end portions and the middle portion of each of the first and second straps have a high level of stress respectively in the direction of the rear and fore stocks whereby a correspondingly high level of force is applied to the support members in the direction of the cushion material by the middle portions of the straps;

the middle portions of the straps each include a side having a predetermined area in said engagement with the first side of the first and second support members; and the second sides of the first and second support members each have a predetermined area larger than that, respectively, of said middle portion predetermined area in engagement with the first sides of the first and second support members, whereby the force applied by the first and second strap middle portions respectively to the first and second support members is distributed over a larger area of the cushion member by the support members and the amount of tearing of the cushion material due to such force is reduced.

19. The retainer according to claim 17 wherein:

the gun case has a length and a width less than the length, the gun case including two spaced apart rigid walls extending in the direction of the length;

the cushion material is positioned between and bears against the two rigid walls; and the support members extend transversely of said length between and toward the two rigid walls whereby the stiffness of the support members maintain the cushion material and gun at a desired location within the gun case by preventing the cushion material from bunching.

20. The retainer according to claim 17 wherein the cushion material, support members and straps are not affixed to the gun case.

* * * * *